United States Patent [19]

Degenhart

[11] 3,943,416

[45] Mar. 9, 1976

[54] ELECTROMAGNETIC SWITCHING DEVICE HAVING AN IMPROVED ENERGIZING CIRCUIT

[75] Inventor: Thomas Wayne Degenhart, Normal, Ill.

[73] Assignee: General Electric Company, New York, N.Y.

[22] Filed: Dec. 18, 1974

[21] Appl. No.: 533,932

[52] U.S. Cl. ..... 317/154

[51] Int. Cl.[2] ..... H01H 47/04

[58] Field of Search ..... 317/154

[56] References Cited

UNITED STATES PATENTS 3,140,429 7/1964 Mais ..... 317/154

*Primary Examiner*—J. D. Miller
*Assistant Examiner*—Harry E. Moose, Jr.
*Attorney, Agent, or Firm*—Stephen A. Young; Walter C. Bernkopf; Robert A. Cahill

[57] ABSTRACT

An electromagnetic switching device having an improved circuit for effecting energization and operation of the device. The device is comprised of a stationary magnetic member, a movable magnetic member in juxtaposition with the stationary magnetic member, and energizing coil magnetically coupled to the stationary and movable magnetic members, at least one stationary contact, and at least one movable contact in juxtaposition with the stationary contact and mechanically coupled to the movable magnetic member. The device is further comprised of full wave rectifying means for converting AC voltage from a source to DC voltage and applying the DC voltage across the energizing coil. Means responsive to movement of the movable magnetic member is further provided for converting the full wave rectifying means to half-way rectifying means to reduce the applied DC voltage across the energizing coil after the movable magnetic member has moved the movable contact into initial electrical contact with the stationary contact and before the movable and stationary contacts are brought into final sealed engagement.

2 Claims, 3 Drawing Figures

ELECTROMAGNETIC SWITCHING DEVICE HAVING AN IMPROVED ENERGIZING CIRCUIT

BACKGROUND OF THE INVENTION

1. Field of The Invention

This invention relates to an electromagnetic device, and more particularly, to a contactor having an improved energizing circuit.

2. Description of The Prior Art

In large electromagnetic devices, such as DC contactors, it has been found that full wave rectified DC power from an AC power source can be applied to an energizing coil of the contactor in order to supply sufficient electromagnetic energy to insure complete closure of the main power switches, which switches are comprised of respective pairs of stationary and movable contacts. However, once the contacts of the contactor are brought into final engagement, it is no longer necessary to apply full-wave rectified DC power to the energizing coil in order to maintain the contacts in a sealed position. If a holding resistor is inserted in series with the energizing coil after the coil has been energized, in order to reduce the applied energy to the coil, the resistor would have to be quite large in physical dimension, and would also dissipate and waste an unnecessary amount of power.

OBJECT OF THE INVENTION

It is therefore an object of this invention to provide a self-contained DC electromagnetic switching device having an improved energizing circuit for assuring full application of energy to the energizing coil prior to closure of the main power contacts and reduced applied energy to the coil after closure of the main power contacts.

Other objects of the invention will be pointed out hereinafter.

SUMMARY OF THE INVENTION

According to a broad aspect of the invention, there is provided an electromagnetic switching device comprising a stationary magnetic member, a movable magnetic member in juxtaposition with the stationary magnetic member, an energizing coil magnetically coupled to the stationary and movable magnetic members, at least one stationary contact, and at least one movable contact in juxtaposition with the stationary contact and mechanically coupled to the movable magnetic member. The device is further comprised of full-wave rectifying means for converting AC voltage from a source to DC voltage and applying the DC voltage across the energizing coil, and means responsive to movement of the movable magnetic member for converting the full-wave rectifying means to half-wave rectifying means to reduce the applied DC voltage across the energizing coil after the movable magnetic member has begun to move toward the stationary magnetic member.

The full-wave rectifying means is comprised of a full-wave bridge rectifier, and the responsive means is comprised of first and second normally closed momentary contact switches and an actuating member having one end thereof mechanically coupled to the movable magnetic member. Another end of the actuating member is spaced from and positioned adjacent to an actuating plunger of the first momentary contact switch when the coil is deenergized, whereby after the coil is energized, the movable magnetic member moves toward the stationary magnetic member and causes the actuating member to depress the actuating plunger of the first momentary contact switch. The first momentary contact switch is in series with one of the diodes of the full-wave bridge rectifier thereby converting the bridge to a half-wave rectifier and, as a result, the DC voltage applied across the energizing coil is reduced.

DESCRIPTION OF THE PREFERRED EMBODIMENT

The invention will now be described with reference to FIGS. 1 through 3.

Figure 1:
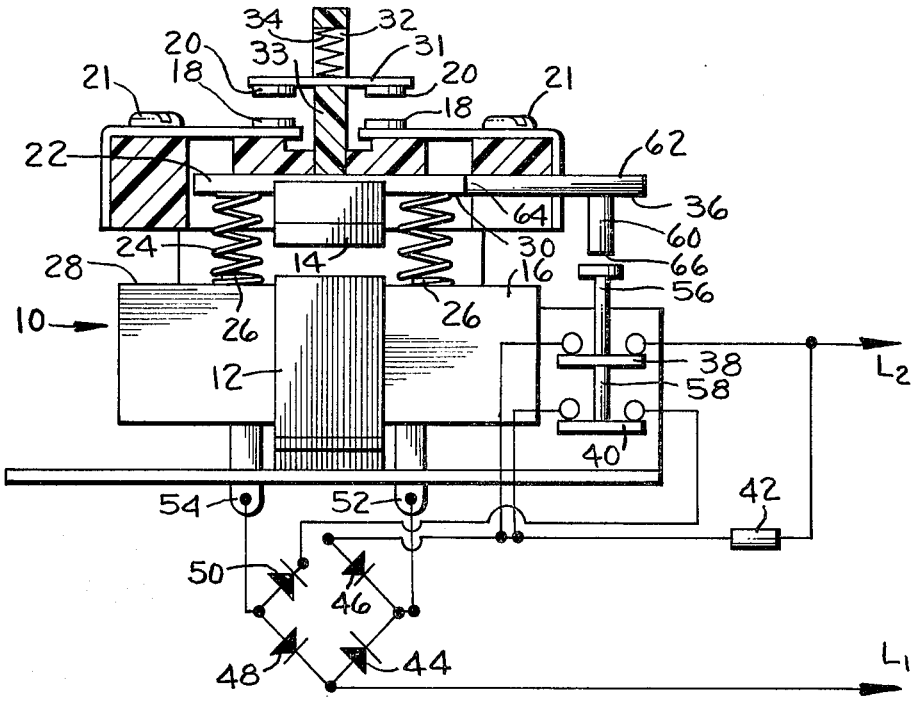
FIG. 1 is a partial sectional view of an electromagnetic switching device, including elements of its energizing circuit, prior to energization of the device.
Figure 2:
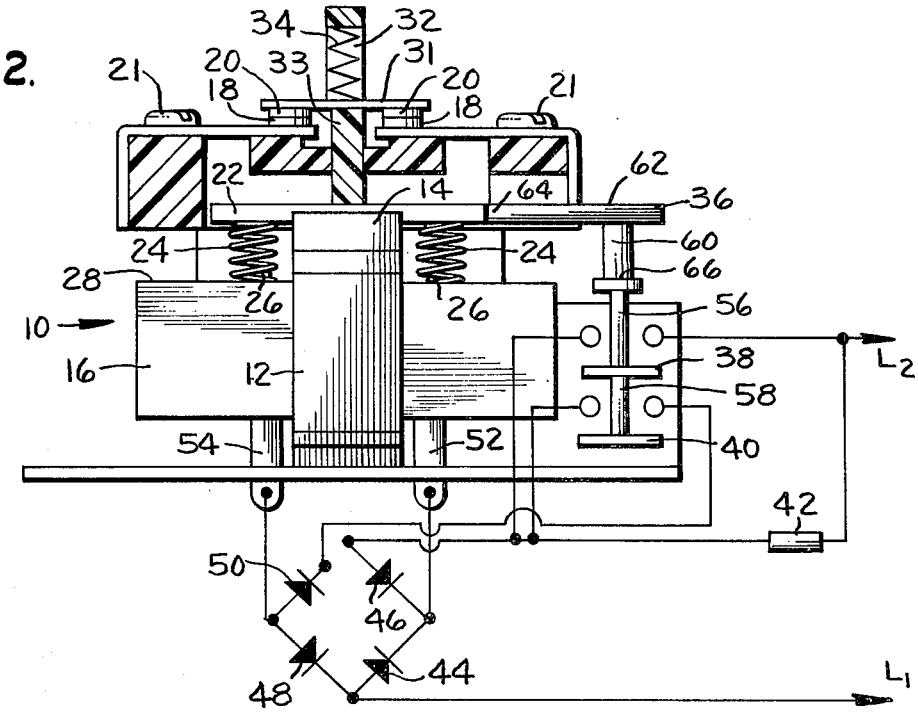
FIG. 2 is a partial sectional view of the device shown in FIG. 1 after the device is energized.
Figure 3:
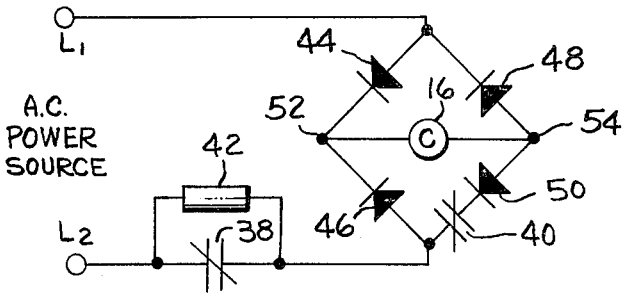
FIG. 3 is an electrical equivalent circuit of the coil energizing circuit shown in FIGS. 1 and 2.

As shown in FIGS. 1 and 2, an electromagnetic switching device, such as a DC contactor 10 is comprised of a stationary magnetic member 12, a movable magnetic member 14, an energizing coil 16, at least one pair of stationary power contacts 18, one pair of movable power contacts 20, and one pair of external contact terminals 21 which are electrically connected to the stationary contacts. The movable contacts are in juxtaposition with the stationary contacts and are mechanically coupled to movable magnetic member 14 via an armature assembly 22. Coil 16 is mounted on stationary magnetic member 12, and is magnetically coupled to the stationary and movable magnetic members. The movable magnetic member is maintained in a position spaced apart from the stationary magnetic member, when the contactor is deenergized, by a pair of return springs 24, which springs are positioned between bosses 26 on a surface 28 of coil 16 and an undersurface 30 of armature assembly 22. Movable contacts 20 are attached to an electrically conductive contact bridge 31, which bridge is seated on a ledge within a window 32 of a vertical portion 33 of armature assembly 22. Contact bridge 31 held on the ledge of the window by a tipspring 34. Further details of the armature assembly, the contactor housing, the other contactor components, and the physical operation of the contactor described above can be found in U.S. Pat. No. 3,806,849, entitled "Small Definite Purpose Contactor," inventor Philip Hughes, and assigned to the same assignee as the assignee of the present invention. At this point, it should also be understood that various other contactor assemblies and/or modifications of the above contactor can be suitable provided, and can be made part of the present invention.

Contactor 10 is further comprised of an actuating member 36, first and second normally closed momentary contact switches 38 and 40, a holding resistor 42, and a full-wave bridge rectifier comprised of first, second, third and fourth diodes 44, 46, 48 and 50. The cathodes of diodes 44 and 46 are electrically connected to one terminal 52 of coil 16, and the anodes of diodes 48 and 50 are electrically connected to another terminal 54 of coil 16. The anode of diode 44 and the cathode of diode 48 are electrically connected to one terminal L1 of an AC power source, while the anode of diode 46 and the cathode of diode 50 are electrically coupled to another terminal L2 of the AC power source. More specifically, normally closed switch 40 is electrically connected between the anode of diode 46 and the cathode of diode 50, while the parallel combination of holding resistor 42 and normally closed switch 38 is electrically connected between the anode of diode 46 and terminal L2 of the AC power source. Normally closed momentary contact switches 38 and 40 have respective actuating plungers 56 and 58 which are mechanically interlocked in such a manner that, when plunger 56 is depressed, switches 38 and 40 are opened. By way of example only, switches 38 and 40 can be contained within one unit of a standard double pole single throw precision snap acting switch, containing two normally closed momentary contact switches, such as model No. CR115B422 sold by the General Purpose Control Products Department of the General Electric Company, Bloomington, Illinois. As shown in FIGS. 1 and 2, actuating member 36 is comprised of a vertical leg 60 and a horizontal cross bar 62 attached to the top of leg 60. One end 64 of cross bar 62 is rigidly attached to movable armature assembly 22 in such a manner that a displacement of movable magnetic member 14 results in a comparable displacement in the position of the bottom 66 of leg 60 of actuating member 36. When the coil is deenergized, movable magnetic member 14 is spaced from stationary magnetic member 12, and the bottom 66 of leg 60 of actuating member 36 is spaced from actuating plunger 56 to the degree that momentary contact switches 38 and 40 remain in their normally closed position. After the contactor has been energized and the main power contacts are closed and sealed, the bottom 66 of leg 60 of actuating member 36 has moved to depress actuating plunger 56 sufficiently to cause momentary contact switches 38 and 40 to open.

The operation of the contact will now be explained. Upon initial application of AC power from an AC power source to the DC contactor, switches 38 and 40 are closed and full-wave rectified DC voltage is applied across terminals 52 and 54 of coil 16. The full application of full-wave rectified DC voltage to the coil provides the necessary electromagnetic energy to cause movable magnetic member 14 to move towards stationary magnetic member 12. The movable magnetic member continues moving toward stationary magnetic member 12 until movable contacts 20 barely touch (kiss) stationary contacts 18. Since, some position after this point, the magnetic energy provided by the application of full-wave rectified DC voltage to the energizing coil is no longer necessary to maintain continued movement of the movable magnetic member toward the stationary magnetic member until the stationary and movable contacts are in their final closed or sealed condition, the bottom 66 of leg 60 of actuating member 36 is predeterminedly positioned to depress actuating plunger 56 and cause a corresponding depression of actuating plunger 58. In this manner, normally closed momentary contact switches 38 and 40 are opened at some point in time between the moment when movable contacts 20 kiss stationary contacts 18 and when these movable and stationary contacts are in their final closed or sealed position. Upon opening of normally closed momentary contacts 38 and 40, current no longer flows from terminal L1 through diode 44, coil 16, diode 50 and back to terminal L2, and the full-wave bridge rectifier is immediately converted to a half-wave rectifier, wherein current only flows from terminal L2 through holding resistor 42, diode 46, coil 16, diode 48 and back to terminal L1.

Inasmuch as the full-wave bridge rectifier is now converted to a half-wave rectifier by the opening of normally closed momentary contact switch 40, a reduced amount of electromagnetic energy is applied to the coil, which energy is still sufficient to insure final closure of the main power contacts after they are brought into the kiss position and maintenance of the main power contacts in the final closed position. Furthermore, since the full-wave bridge rectifier has been converted into a half-wave rectifier, less power is dissipated by resistor 42 than would otherwise be the case if full-wave rectified power were still being applied to the coil. This results in the use of a less expensive, smaller wattage holding resistor than would otherwise be required. Thus, by converting the full-wave bridge rectifier to a half-wave rectifier, the output efficiency of the contactor is increased by the decrease in dissipation of power by holding resistor 42.

When the diode bridge is operating as a half-wave rectifier, no current flows from terminal L1 through diode 44, coil 16, diode 50 and back to terminal L2. During that part of the operating cycle when L1 is positive in polarity with respect to L2, diode 44 acts as a free wheeling diode and current flows through diode 44, coil 16, diode 48 and back to diode 44 even though zero current is being drawn from the AC power source at this point in time. Thus, the free wheeling action provided by diode 44 insures continuation in the flow of current through coil 16 during the full operating cycle, and also insures smooth quiet operation of the contactor.

While the invention has been described with reference to the fact that end 64 of cross bar 62 of actuating member 36 is fixed to movable armature assembly 22, it should be understood that end 64 of the cross bar of the actuating member could as easily and conveniently be mechanically and rigidly fixed directly to movable magnetic member 14.

Although the invention has been described with reference to a specific embodiment thereof, numerous modifications are possible without departing from the invention, and it is desired to cover all modifications falling within the spirit and scope of this invention.

What I claim as new and desire to secure by Letters Patent of the United States is:

1. An electromagnetic switching device comprising:

a. a stationary magnetic member;

b. a movable magnetic member in juxtaposition with said stationary magnetic member;

c. an energizing coil magnetically coupled to said stationary and movable magnetic members;

d. at least one stationary contact:

e. at least one movable contact in juxtaposition with said stationary contact and mechanically coupled to said movable magnetic member;

f. full-wave rectifying means for converting AC voltage from a source to DC voltage and applying the DC voltage across said energizing coil, said full-wave rectifying means being comprised of first, second, third and fourth diodes, the cathodes of said first and second diodes being electrically coupled to one end of said coil and the anodes of said third and fourth diodes being electrically coupled to the other end of said coil, the anode of said first diode and the cathode of said third diode being electrically connected to one terminal of the AC voltage source; and g. means responsive to movement of said movable magnetic member for converting said full-wave rectifying means to half-wave rectifying means to reduce the applied DC voltage across said energizing coil after said movable magnetic member has begun to move toward said stationary magnetic member, said responsive means being comprised of:

i. a first normally closed momentary contact switch having an actuating plunger, said first mementary contact switch being electrically connected in series only with said first and fourth of said first, second, third and fourth diodes;

ii. a second normally closed momentary contact switch having an actuating plunger mechanically coupled to said actuating plunger of said first momentary contact switch, said second momentary contact switch having one end electrically connected to another terminal of the AC voltage source and having another end electrically coupled to the anode of said second diode and to the cathode of said fourth diode;

iii. an actuating member having one end thereof mechanically coupled to said movable magnetic member, and another end thereof spaced from and positioned adjacent said actuating plunger of one of said first and second momentary contact switches when said coil is deenergized; and iiii. a holding resistor electrically connected in parallel with said second momentary contact switch, whereby after said coil is energized, said movable magnetic member moves toward said stationary magnetic member and causes said actuating member to depress said actuating plunger of one of said first and second momentary contact switches to open said first and second momentary contact switches, and insert said holding resistor in series with said second diode, said energizing coil and said third diode as current passes from one terminal of the AC source to the other terminal of the AC source during each half cyclee cycle a signal from the AC source.

2. An electromagnetic switching device according to claim 1, wherein said other end of said actuating member is spaced from said actuating plunger a predetermined distance sufficient to cause said first momentary contact switch to open after said movable contact is initially brought into electrical contact with said stationary contact and before said movable and stationary contacts are brought into final sealed engagement by the movement of said movable magnetic member.

* * * * *

UNITED STATES PATENT OFFICE

CERTIFICATE OF CORRECTION

Patent No. 3,943,416 Dated March 9, 1976

Inventor(s) Degenhart, Thomas W.

It is certified that error appears in the above-identified patent and that said Letters Patent are hereby corrected as shown below:

Column 5, line 11, delete "mementary" and insert -- momentary --

Column 6, line 16, delete "cyclee"

Column 6, line 16, after "cycle", insert -- of --

Signed and Sealed this twenty-second Day of June 1976

[SEAL]

Attest:

RUTH C. MASON
Attesting Officer

C. MARSHALL DANN
Commissioner of Patents and Trademarks